US005975327A

United States Patent [19]

Funk

[11] Patent Number: 5,975,327

[45] Date of Patent: Nov. 2, 1999

[54] COVERING TAB FOR A BEVERAGE CAN OPENING

[76] Inventor: Gerald L. Funk, 11000 Wharf Rd., Waynesboro, Pa. 17268

[21] Appl. No.: 09/031,481

[22] Filed: Feb. 26, 1998

[51] Int. Cl.[6] ..... B65D 17/20

[52] U.S. Cl. ..... 220/269

[58] Field of Search ..... 220/269, 270, 220/260, 265

[56] References Cited

U.S. PATENT DOCUMENTS

| | | | |
|---|---|---|---|
| 3,259,265 | 7/1966 | Stuart | 220/269 |
| 3,462,042 | 8/1969 | Stolle | 220/269 |
| 3,738,526 | 6/1973 | Zundel et al. | 220/269 |
| 4,537,326 | 8/1985 | Morehead | 220/713 X |
| 4,720,022 | 1/1988 | Gomes | 220/269 |
| 5,190,149 | 3/1993 | Krause | 220/269 |
| 5,285,924 | 2/1994 | Morris . | |
| 5,555,993 | 9/1996 | Borkowski et al. | 220/906 X |
| 5,775,534 | 7/1998 | Webb et al. | 220/906 X |
| 5,813,559 | 9/1998 | Cho | 220/906 X |

*Primary Examiner*—Joseph M. Moy

[57] ABSTRACT

A new beverage can opening tab for preventing insects from entering the interior of a beverage can through the beverage can opening. The inventive device includes a tab body with a seal opening portion, a mounting portion, a lifting portion, and at least one wing portion positioned adjacent the lifting portion. The mounting portion is mountable to the top lid of a beverage can such that the tab body is rotatable between an opening position and a covering position over the top lid. When the tab body is in the opening position, the seal opening portion is positioned adjacent the opening of the can so that the seal opening portion may be pivoted to open the frangible sealing member covering the opening on the top lid into the interior of the can. When the tab body is rotated to the covering position, the wing portion and the lifting portion are positioned over the opening to cover the opening in order to prevent insects from passing through the opening into the interior of can.

7 Claims, 2 Drawing Sheets

COVERING TAB FOR A BEVERAGE CAN OPENING

BACKGROUND OF THE INVENTION

1. Field of the Invention

The present invention relates to beverage can opening tabs and more particularly pertains to a new beverage can opening tab for preventing insects from entering the interior of a beverage can through the beverage can opening.

2. Description of the Prior Art

The use of beverage can opening tabs is known in the prior art. More specifically, beverage can opening tabs heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage can opening tabs include U.S. Pat. No. 4,887,712; U.S. Pat. No. 4,720,022; U.S. Pat. No. 4,681,238; U.S. Pat. No. 5,285,924; U.S. Pat. No. 4,951,835; and U.S. Pat. No. Des. 268,250.

While these devices fulfill their respective, particular objectives and requirements, the aforementioned patents do not disclose a new beverage can opening tab. The inventive device includes a tab body with a seal opening portion, a mounting portion, a lifting portion, and at least one wing portion positioned adjacent the lifting portion. The mounting portion is mountable to the top lid of a beverage can such that the tab body is rotatable between an opening position and a covering position over the top lid. When the tab body is in the opening position, the seal opening portion is positioned adjacent the opening of the can so that the seal opening portion may be pivoted to open the frangible sealing member covering the opening on the top lid into the interior of the can. When the tab body is rotated to the covering position, the wing portion and the lifting portion are positioned over the opening to cover the opening in order to prevent insects from passing through the opening into the interior of can.

In these respects, the beverage can opening tab according to the present invention substantially departs from the conventional concepts and designs of the prior art, and in so doing provides an apparatus primarily developed for the purpose of preventing insects from entering the interior of a beverage can through the beverage can opening.

SUMMARY OF THE INVENTION

In view of the foregoing disadvantages inherent in the known types of beverage can opening tabs now present in the prior art, the present invention provides a new beverage can opening tab construction wherein the same can be utilized for preventing insects from entering the interior of a beverage can through the beverage can opening.

The general purpose of the present invention, which will be described subsequently in greater detail, is to provide a new beverage can opening tab apparatus and method which has many of the advantages of the beverage can opening tabs mentioned heretofore and many novel features that result in a new beverage can opening tab which is not anticipated, rendered obvious, suggested, or even implied by any of the prior art beverage can opening tabs, either alone or in any combination thereof.

To attain this, the present invention generally comprises a tab body with a seal opening portion, a mounting portion, a lifting portion, and at least one wing portion positioned adjacent the lifting portion. The mounting portion is mountable to the top lid of a beverage can such that the tab body is rotatable between an opening position and a covering position over the top lid. When the tab body is in the opening position, the seal opening portion is positioned adjacent the opening of the can so that the seal opening portion may be pivoted to open the frangible sealing member covering the opening on the top lid into the interior of the can. When the tab body is rotated to the covering position, the wing portion and the lifting portion are positioned over the opening to cover the opening in order to prevent insects from passing through the opening into the interior of can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage can opening tab apparatus and method which has many of the advantages of the beverage can opening tabs mentioned heretofore and many novel features that result in a new beverage can opening tab which is not anticipated, rendered obvious, suggested, or even implied by any of the prior art beverage can opening tabs, either alone or in any combination thereof.

It is another object of the present invention to provide a new beverage can opening tab which may be easily and efficiently manufactured and marketed.

It is a further object of the present invention to provide a new beverage can opening tab which is of a durable and reliable construction.

An even further object of the present invention is to provide a new beverage can opening tab which is susceptible of a low cost of manufacture with regard to both materials and labor, and which accordingly is then susceptible of low prices of sale to the consuming public, thereby making such beverage can opening tab economically available to the buying public.

Still yet another object of the present invention is to provide a new beverage can opening tab which provides in the apparatuses and methods of the prior art some of the advantages thereof, while simultaneously overcoming some of the disadvantages normally associated therewith.

Still another object of the present invention is to provide a new beverage can opening tab for preventing insects from entering the interior of a beverage can through the beverage can opening.

Yet another object of the present invention is to provide a new beverage can opening tab which includes a tab body with a seal opening portion, a mounting portion, a lifting portion, and at least one wing portion positioned adjacent the lifting portion. The mounting portion is mountable to the top lid of a beverage can such that the tab body is rotatable between an opening position and a covering position over the top lid. When the tab body is in the opening position, the seal opening portion is positioned adjacent the opening of the can so that the seal opening portion may be pivoted to open the frangible sealing member covering the opening on the top lid into the interior of the can. When the tab body is rotated to the covering position, the wing portion and the lifting portion are positioned over the opening to cover the opening in order to prevent insects from passing through the opening into the interior of can.

Still yet another object of the present invention is to provide a new beverage can opening tab that provides a means for helping prevent children from inserting their fingers into the opening of a beverage can and risk cutting their fingers on the edge of the opening.

Even still another object of the present invention is to provide a new beverage can opening tab that helps cover the opening of a beverage can to help prevent liquids within the can from spilling out when the can is tipped over or accidentally knocked around.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
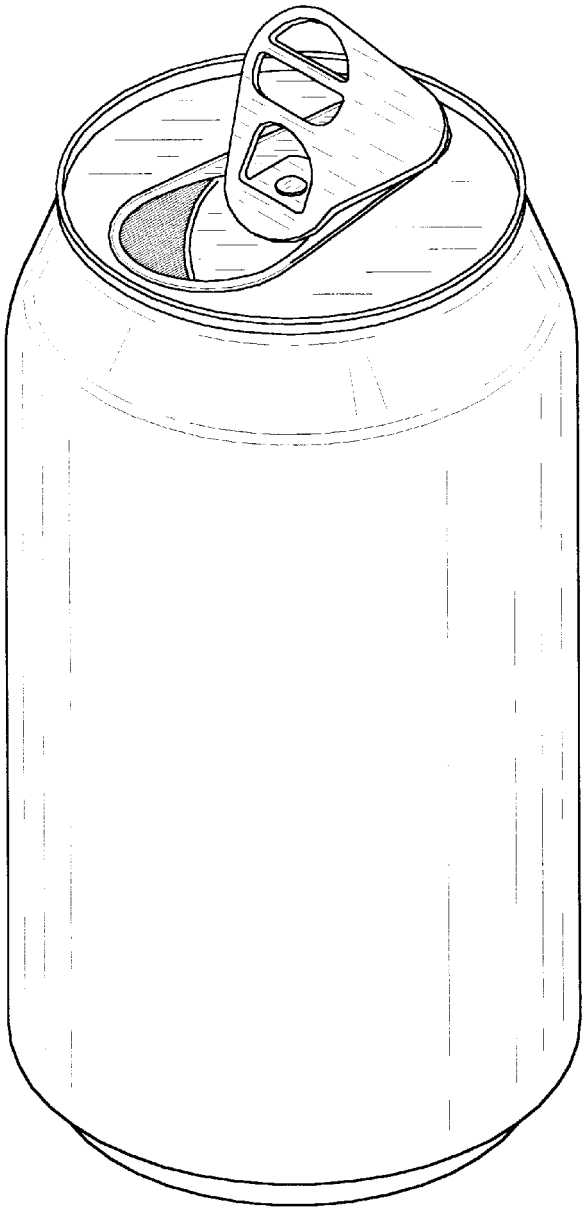
FIG. 1 is a schematic perspective view of a new beverage can opening tab mounted on the top of a beverage can according to the present invention.

With reference now to the drawings, and in particular to FIGS. 1 through 6 thereof, a new beverage can opening tab embodying the principles and concepts of the present invention and generally designated by the reference numeral 10 will be described.

As best illustrated in FIGS. 1 through 6, the beverage can opening tab 10 is designed for mounting to the top lid 2 of a beverage can 1. The beverage can opening tab 10 generally comprises a tab body 12 with a seal opening portion 14, a mounting portion 16, a lifting portion 18, and at least one wing portion 20 positioned adjacent the lifting portion.

Figure 2:
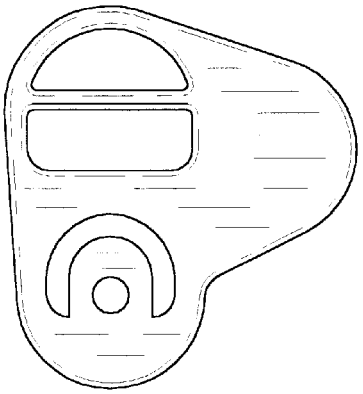
FIG. 2 is a top side view of the present invention.
Figure 3:
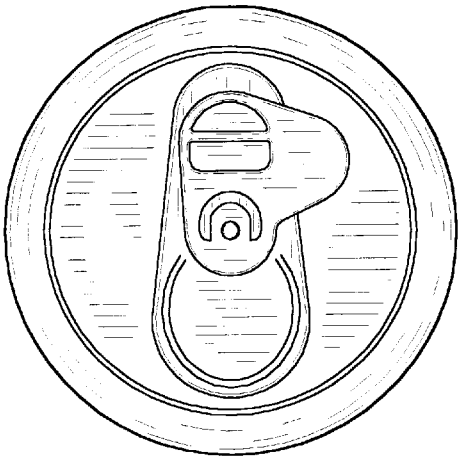
FIG. 3 is a schematic top side view of the present invention on an unopened beverage can.
Figure 4:
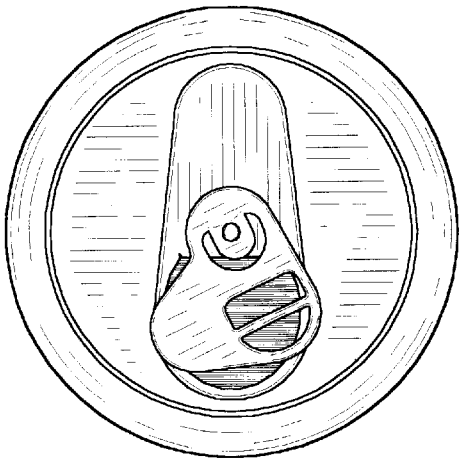
FIG. 4 is a schematic top side view of the present invention in position covering the opening into the interior of a beverage can.

Preferably, the tab body 12 is substantially planar with the seal opening portion 14, the mounting portion 16, and the lifting portion 18 all aligned along the longitudinal axis 34 of the tab body 12. With reference to FIG. 2, the mounting portion 16 is located between the lifting portion 18 and the seal opening portion 14 along the longitudinal axis 34.

The mounting portion 16 is mountable to the top lid 2 of a beverage can 1 to permit pivoting of the tab body 12 on an axis parallel to the plane of the top lid 2 so that the seal opening portion 14 may be pivoted to break the frangible sealing member 3 covering a beverage can opening 4. The mounting portion 16 is also mountable to the top lid 2 of a beverage can 1 to permit rotation of the tab body 12 about an axis perpendicular to the plane of the top lid 2. This permits rotation of the tab body 12 between an opening position 30 and a covering position 32 over the top lid 2. When the tab body 12 is in the opening position 30, the seal opening portion 14 is positioned adjacent the opening 4 of the can 1 so that the seal opening portion 14 may be pivoted to open the frangible scaling member 3 covering the opening 4 on the top lid 2 into the interior of the can 1. When the tab body 12 is rotated to the covering position 32, the wing portion 20 and the lifting portion 18 are positioned over the opening 4 to cover the opening 4 in order to prevent insects from passing through the opening 4 into the interior of can 1.

The lifting portion 18 has a finger aperture 24 to permit insertion of a user's finger when lifting the lifting portion 18 to break the frangible sealing member 3 to open the opening 4 of a can 1. Preferably, the lifting portion 18 has a crossbar 26 extending laterally across the finger aperture 24. The crossbar 26 is designed to prevent insects from passing through the finger aperture 24 especially when the lifting portion is positioned over the opening 4 of the can 1 when the tab body is positioned in the covering position 32.

Figure 5:
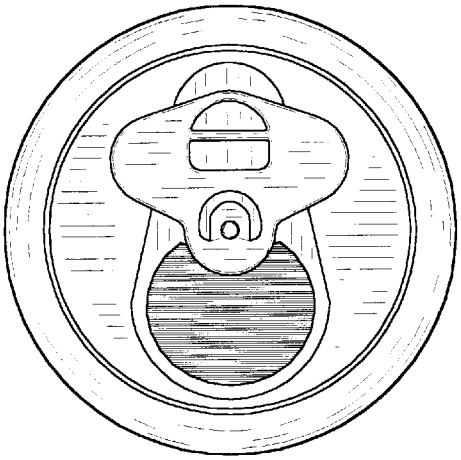
FIG. 5 is a schematic top side view of an optional embodiment of the present invention mounted on a beverage can.
Figure 6:
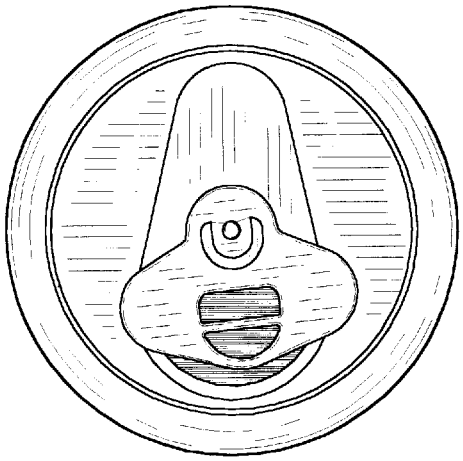
FIG. 6 is a schematic top side view of an optional embodiment of the present invention covering the opening of a beverage can.

Optionally, the tab body 12 may include a pair of wing portions 20,22. This embodiment is preferred for beverage cans 1 having large or "wide-mouth" openings 4. As depicted in FIGS. 5 and 6, in such an optional embodiment, the wing portions are extended laterally outwards in opposite directions from the longitudinal axis 34 of the tab body with the lifting portion 18 positioned between the wing portions 20,22. In such an embodiment, as shown in FIG. 6, the wing portions 20,22 and the lifting portion 18 are positioned over the can opening 4 when the tab body is rotated to the covering position 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage can opening tab for mounting to a beverage container having a top lid and a frangible sealing member, said top lid having a opening into the interior of said beverage container, said frangible sealing member closing said beverage container opening, said beverage can opening tab comprising:

a tab body having a longitudinal axis, a seal opening portion, a mounting portion, a lifting portion, and a single wing portion;

said lifting portion having an arcuate outer perimeter having a continuous radius of curvature;

said wing portion being positioned adjacent said lifting portion to one side of said outer perimeter of said lifting portion;

said wing portion having an outer perimeter comprising a pair of substantially straight side regions and an arcuate middle region interposed between said substantially straight regions of said outer perimeter of said wing portion;

said side regions of said outer perimeter of said wing portion being extended obliquely from one another to define an acute angle therebetween;

a first of said side regions of said outer perimeter of said wing portion being extended tangentially from said arcuate outer perimeter of said lifting portion and tangentially from said arcuate middle region of said outer perimeter of said wing portion;

said mounting portion being mountable to the top lid of a beverage container to permit rotation of said tab body about an axis perpendicular to the plane of the top lid of a container and to permit pivoting of said tab body on an axis parallel to the plane of the top lid of a container;

said tab body being selectively rotatable back and forth between an opening position and a covering position, said seal opening portion being positionable adjacent the opening of a beverage container when said tab body is positioned in said opening position, said wing portion and said lifting portion being positionable over the opening of a beverage container when said tab body is positioned in said covering position to cover the opening of a beverage container to prevent insects from passing through the opening into an interior of a beverage container; and said lifting portion and wing portion each having a width defined perpendicular to said longitudinal axis of said tab body, wherein said widths of said lifting and wing portions are about equal to each other.

2. The beverage can opening tab of claim 1, wherein said tab body is substantially planar.

3. The beverage can opening tab of claim 1, wherein said tab body has a longitudinal axis, and wherein said seal opening portion, said mounting portion, and said lifting portion are aligned along said longitudinal axis.

4. The beverage can opening tab of claim 3, wherein said mounting portion is located between said lifting portion and said seal opening portion.

5. The beverage can opening of claim 1, wherein said lifting portion has a finger aperture.

6. The beverage can opening of claim 5, wherein said lifting portion has a crossbar extending across said finger aperture.

7. The beverage can opening tab of claim 1 in combination with a beverage container having a top lid and a frangible sealing member, said top lid having an opening into the interior of said beverage container, said frangible sealing member closing said beverage container opening, and wherein said mounting portion is mounted to said top lid of said beverage container to permit rotation of said tab body about an axis perpendicular to the plane of said top lid of said container and to permit pivoting of said tab body on an axis parallel to the plane of said top lid of said container.

* * * * *